United States Patent [19]

Furlan et al.

[11] Patent Number: 4,754,382

[45] Date of Patent: Jun. 28, 1988

[54] MOTOR VEHICLE HEADLIGHT

[75] Inventors: Giovanni Furlan; Giuseppe Caputo; Giorgio Manunta, all of Turin, Italy

[73] Assignee: Carello Industriale S.p.A., Turin, Italy

[21] Appl. No.: 110,099

[22] Filed: Oct. 13, 1987

Related U.S. Application Data

[63] Continuation of Ser. No. 843,254, Mar. 24, 1986, abandoned.

[30] Foreign Application Priority Data

Apr. 9, 1985 [IT] Italy ..... 53212[U]

[51] Int. Cl.[4] ..... F21V 7/00

[52] U.S. Cl. ..... 362/305; 362/304; 362/310

[58] Field of Search ..... 362/304, 305, 310, 353, 362/61, 341, 347, 257, 353

[56] References Cited

U.S. PATENT DOCUMENTS

| | | | |
|---|---|---|---|
| Re. 15,088 | 4/1921 | Schroeder | 362/304 |
| 1,305,498 | 6/1910 | Schroeder | 362/304 |
| 1,375,418 | 4/1921 | Schroeder | 362/304 |
| 1,389,273 | 8/1921 | Schroeder | 362/304 |
| 2,305,818 | 12/1952 | Tura | 362/305 |
| 4,544,999 | 10/1985 | Kawanami et al. | 362/304 |
| 4,545,000 | 10/1985 | Fraley et al. | 362/304 |

*Primary Examiner*—Raymond A. Nelli

*Attorney, Agent, or Firm*—Pearne, Gordon, McCoy & Granger

[57] ABSTRACT

A motor vehicle headlight whereby the light rays emitted by a rear portion of a lamp, mounted on the focal point of a paraboloid reflector and supported on a lampholder located on the focal axis of the reflector and supported by the same, are intercepted by a collar-shaped dimmer surrounding a lamp portion facing the respective lampholder.

11 Claims, 2 Drawing Sheets

MOTOR VEHICLE HEADLIGHT

This is a continuation of application Ser. No. 843,254, filed on Mar. 24, 1986, now abandoned.

BACKGROUND OF THE INVENTION

The present invention relates to a motor vehicle headlight.

Known motor vehicle headlights generally comprise a paraboloid reflector closed at the front by a protective transparent shield and provided, at the rear, with a through hole usually coaxial with the optical axis of the headlight. Through the said hole, there is usually fitted and secured a lampholder extending inside the reflector and supporting, on its front end, a lamp having filaments located on the local point of the reflector itself.

For obtaining a light beam of given width and direction from the said headlight, known headlights are known to intercept both the direct light rays emitted from the front of the lamp, and the so-called parasitic light rays emitted from the rear of the lamp, away from the focal point of the reflector, that is, between the focal point and the rear of the reflector.

The direct rays emitted from the front of the lamp are usually intercepted by providing, inside the reflector, a dimming hood located in front of the lamp and along the optical axis of the reflector, or by simply coating the front of the lamp with paint impervious to light.

Intercepting the said parasitic light tays is generally more problematic, in that they bounce off the reflector to define parasitic beams usually diverging upwards and downwards in relation to the main beam produced by the light rays emitted by the lamp on the focal point of the reflector and reflected by the latter.

Of the aforementioned two parasitic beams, the upward-diverging one, which may dazzle oncoming vehicles, is usually intercepted by means of a secondary dimming hood fitted onto the reflector, over the central dimming hood. Alternatively, the lamp is provided with two tabs extending upwards and downwards from the front end of the lamp base and designed to intercept the parasitic rays in such a manner as to prevent their reaching the surface of the reflector.

It should be pointed out, in this connection, that not all currently enforced standards governing the brilliancy of headlights require the use of lamps having reflecting tabs, whereas secondary dimming hoods generally prove unsightly and relatively expensive.

SUMMARY OF THE INVENTION

The aim of the present invention is to provide a motor vehicle headlight structured in such a manner as to enable straightforward, low-cost interception of the said parasitic rays, and with no negative effect on the appearance of the headlight itself.

With this aim in view, according to the present invention, there is provided a motor vehicle headlight comprising a paraboloid reflector with a rear through hole substantially coaxial with the optical axis of the said reflecor, a lampholder mounted through the said hole and integral with the said reflector, and a lamp mounted on the said lampholder on the focal point of the said reflector, characterised by the fact that it comprises a substantially collar-shaped dimming member integral with the said reflector, the said collar-shaped dimming member surrounding a rear portion of a bulb on the said lamp.

BRIEF DESCRIPTION OF THE DRAWINGS

The present invention will be described by way of examples with reference to the accompanying drawings in which.

DETAILED DESCRIPTION OF THE INVENTION

Figure 1:
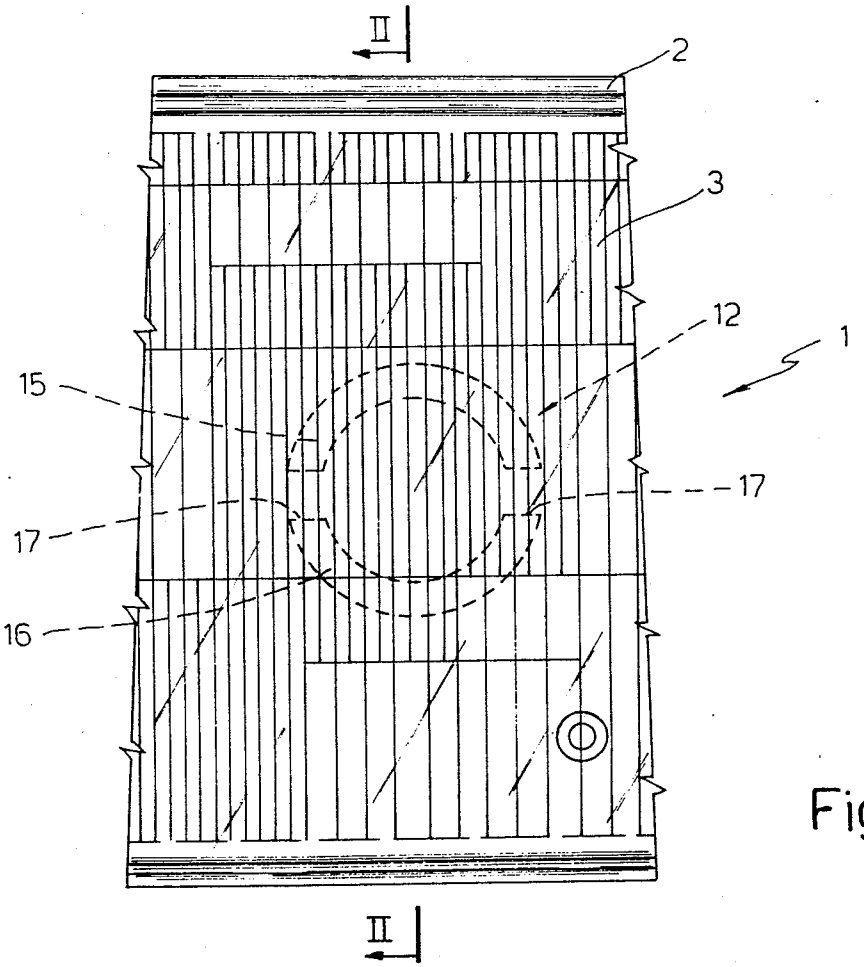
FIG. 1 shows a partial front view of a motor vehicle headlight according to the teachings of the present invention.
Figure 2:
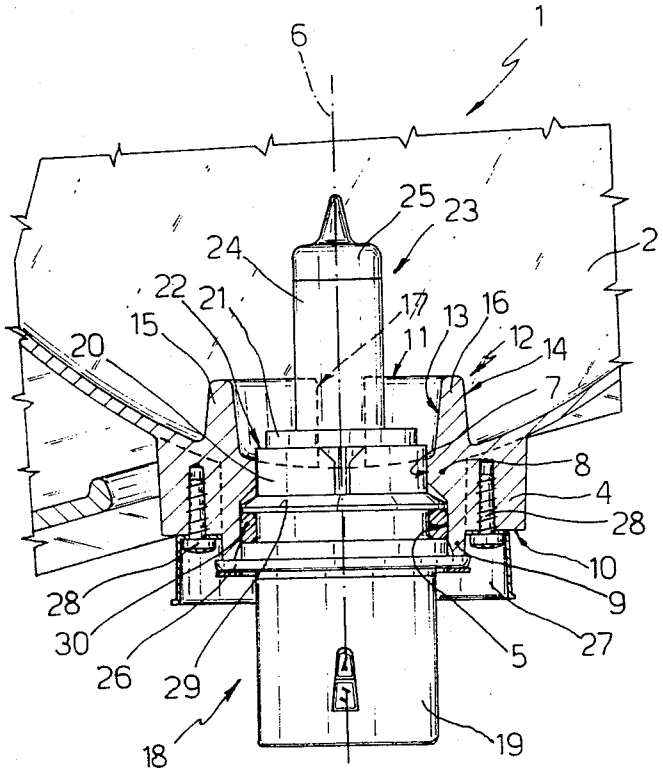
FIG. 2 shows a section along line II—II in FIG. 1.

Number 1 in FIGS. 1 and 2 indicates a motor vehicle headlight comprising a paraboloid reflector 2 closed at the front by a transparent screen 3 usually consisting of glass or other similar material.

As shown, particularly in FIG. 2, the rear part of reflector 2 presents an outer annular base 4 having, together with reflector 3, a through hole 5 substantially coaxial with the optical axis 6 of reflector 3. Hole 5 comprises a limited front portion 7 defined by an annular rib 8 extending radially inwards from the inner surface of base 4. The said base 4 is provided with an annular appendix 9 extending axially rearwards of a rear annular surface 10 of base 4 itself.

At base 4, reflector 2 is provided at the front with a substantially annular rib 11 coaxial with base 4 and having an inside diameter substantially equal to that of hole 5. Rib 11 defines a substantially annular dimmer 12 the inner surface 13 of which is coated with non-reflecting material, and the outer surface 14 of which is coated with reflecting material. Dimmer 12 may be either continuous or, as shown in FIGS. 1 and 2, divided into an upper portion 15 and a lower portion 16 by two axial cuts 17.

In the embodiment shown in FIGS. 1 and 2, reflector 2 is formed from plastic, and base 4 and dimmer 12 are molded unitary with reflector 2. Alternatively, according to a variation not shown, reflector 2 is formed from metal, and base 4 and dimmer 12 are formed from plastic or metal and rendered integral with reflector 2 by means of clinching, welding, bonding or other similar connecting methods. As shown in FIG. 2, hole 5 is engaged by a lampholder indicated as a whole by 18 and comprising a rear tubular body 19 open at the rear and covering electrical terminals (not shown), and a front tubular body 20 the outside diameter of which is equal to the inside diameter of limited portion 7 of hole 5. From the front end of front tubular body 20, there extends axially forward a tubular appendix 21 defining an annular shoulder 22 on the front end surface of tubular body 20 and surrounding a receptacle (not shown) for the base (not shown) of a lamp 23. Bulb 24 of lamp 23 projects frontwards of lampholder 18 and presents a built-in front dimmer 25 formed by coating a front portion of bulb 24 with paint or similar substance impervious to light, and internally reflective.

Tubular bodies 19 and 20 are separated by an outer annular flange 26 supported contacting the free rear end of appendix 9 and maintained contacting appendix 9 by means of an annular fastening body 27 fitted onto tubular body 19 and secured contacting surface 10 by means of a number of screws 28 connecting annular body 27 to base 4.

A front portion of tubular body 20 engages the limited portion 7 of hole 5 and is provided with an annular flange 29 the outside diameter of which is equal to the diameter of hole 5, and the front surface of which is arranged contacting the rear axial surface of rib 8. Tubular body 20 is fitted with an annular seal 30 compressed between flanges 26 and 29 and the inner surface of hole 5 for the purpose of sealing between lampholder 18 and base 4.

Figure 3:
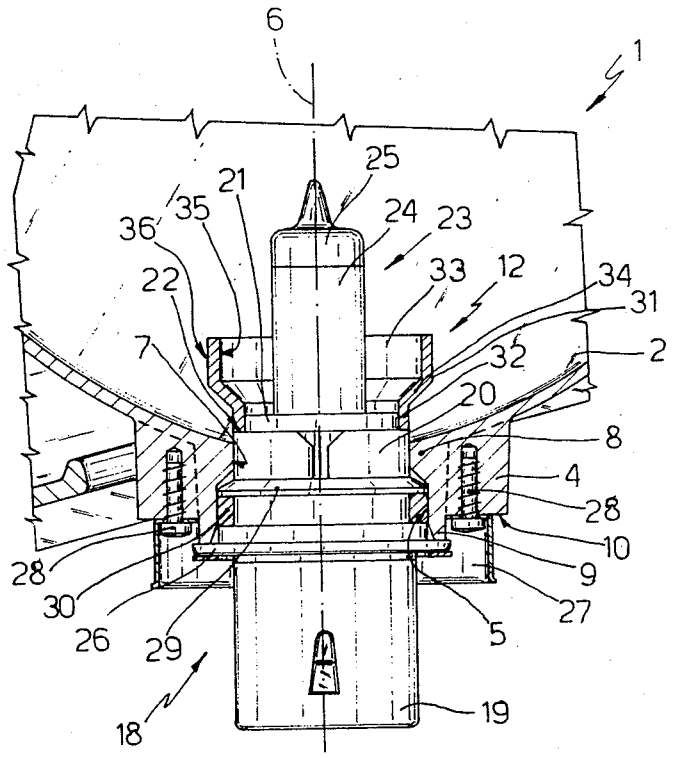
FIG. 3 is similar to FIG. 2 and shows a variation of the headlight shown in FIGS. 1 and 2.

The substantially dimmer 12 in the variation shown in FIG. 3 consists of a tubular body 31 comprising two cylindrical portions 32 and 33 blended by a truncated-cone portion 34 and of which the first presents a smaller inside diameter than the second.

In the variation shown in FIG. 3, annular dimmer 12 is detached from reflector 2 and is supported by the same by means of lampholder 18 to which dimmer 12 is connected in releasable manner. In more detail, dimmer 12 and lampholder 18 are connected by pressure-fitting a rear end portion of portion 32 of tubular body 31 onto appendix 21 until the rear end of tubular body 31 contacts shoulder 22.

Like dimmer 12 in FIGS. 1 and 2, tubular body 31 presents an inner surface 35 coated with non-reflecting material, and an outer surface 36 coated with reflecting material. Though portion 33 of tubular body 31 defines, in the example shown, a continuous cylindrical collar about lamp 23, the said portion 33 may obviously be divided into two portions (not shown) by means of axial cuts (not shown) similar to cuts 17 on dimmer 12 in FIGS. 1 and 2.

As shown in FIGS. 2 and 3, dimmer 12 defines a collar substantially surrounding a rear portion of bulb 24 on lamp 23, and designed to intercept any parasitic light rays from the rear part of bulb 24, and so prevent the said parasitic light rays from reaching the inner reflecting surface of reflector 2 and from being projected to the outside.

I claim:

1. A motor vehicle headlight comprising a paraboloid reflector with a rear through hole substantially coaxial with the optical axis of the said reflector, a lampholder mounted through the said hole and integral with the said reflector, and a lamp mounted on the said lampholder on the focal point of the said reflector, characterised by the fact that it comprises a substantially collar-shaped dimming member integral with the said reflector, the said collar-shaped dimming member surrounding a rear portion of a bulb on the said lamp between said bulb and the rear portion of said reflector at said through hole, and having a non-reflecting surface facing said rear portion of said bulb.

2. A headlight as claimed in claim 1, characterised by the fact that the said collar-shaped dimming member is one piece with the said paraboloid reflector.

3. A headlight as claimed in claim 2, characterised by the fact that the said reflector and the said dimming member are formed from plastic and molded in one piece.

4. A headlight as claimed in claim 1, characterised by the fact that the said dimming member comprises a substantially tubular body connected to the said lampholder and extending forward from a front end of the same.

5. A headlight as claimed in claim 4, characterised by the fact that the said lampholder presents a front appendix fitted in a releasable manner and by pressure inside the rear end of the said substantially tubular body.

6. A headlight as claimed in claim 1, characterised by the fact that the said collar has two axial cuts dividing it into two portions.

7. A motor vehicle headlight comprising a paraboloid reflector having a principal axis, a lampholder mounted to said reflector, and a lamp mounted on the lampholder and having a bulb on the axis and on the focal point of the reflector forward of the intersection of the axis and the reflector, characterised by a substantially collar-shaped dimming member mounted in a fixed position relative to said reflector, said dimming member being positioned to the rear of said focal point relative to the paraboloid reflector to eliminate parasitic rays emitted toward the rear of said focal point; said collar-shaped dimming member being substantially closed on said reflector substantially to eliminate light rays from the lamp striking the reflector at points to the rear of said focal point.

8. A headlight as claimed in claim 7, wherein the surface of said dimming member facing said lamp is substantially non-reflective.

9. A headlight as claimed in claim 7, wherein said dimming member is entirely to the rear of said focal point.

10. A headlight as claimed in claim 7, wherein said substantially collar-shaped dimming member is substantially coaxial with said principal axis.

11. A motor vehicle headlight comprising a paraboloid reflector having a principal axis, a lampholder mounted to said reflector, and a lamp mounted on the lampholder and having a bulb on the axis and on the focal point of the reflector forward of the intersection of the axis and the reflector, characterised by a substantially collar-shaped dimming member mounted in a fixed position relative to said reflector, said dimming member being positioned to the rear of said focal point relative to the paraboloid reflector to eliminate parasitic rays emitted toward the rear of said focal point, said dimming member having said collar-shape with an axis substantially coincident with the principal axis of revolution of said paraboloid reflector, and said dimming member extending from said reflector to approximately the midpoint of the source of light of said lamp.

* * * * *

UNITED STATES PATENT AND TRADEMARK OFFICE

CERTIFICATE OF CORRECTION

PATENT NO. : 4,754,382

DATED : June 28, 1988

INVENTOR(S) : Furlan et al.

It is certified that error appears in the above-identified patent and that said Letters Patent is hereby corrected as shown below:

Column 1, line 17, "local" should be --focal--

Column 1, line 30, "tays" should be --rays--

Column 3, line 11, after "substantially" insert --annular--.

Signed and Sealed this

Twentieth Day of December, 1988

*Attest:*

DONALD J. QUIGG

*Attesting Officer*

*Commissioner of Patents and Trademarks*